US005308144A

United States Patent [19]

Korn

[11] Patent Number: 5,308,144

[45] Date of Patent: May 3, 1994

[54] CHAIR, IN PARTICULAR WORK OR OFFICE CHAIR

[75] Inventor: Heinrich Korn, Maintal, Fed. Rep. of Germany

[73] Assignee: Roeder GmbH, Fed. Rep. of Germany

[21] Appl. No.: 730,243

[22] Filed: Jul. 15, 1991

Related U.S. Application Data

[63] Continuation-in-part of Ser. No. 526,463, May 21, 1990, abandoned.

[30] Foreign Application Priority Data

May 20, 1989 [DE] Fed. Rep. of Germany ..... 3916474

[51] Int. Cl.[5] ..... A47C 1/032

[52] U.S. Cl. ..... 297/301; 297/320

[58] Field of Search ..... 297/300, 301, 302, 304, 297/320

[56] References Cited

U.S. PATENT DOCUMENTS 4,502,729 5/1985 Locker ..... 297/301
4,668,012 5/1987 Locker ..... 297/301

FOREIGN PATENT DOCUMENTS 0176816 4/1986 European Pat. Off. .
0237825 9/1987 European Pat. Off. .
263323 11/1987 European Pat. Off. .
281845 9/1989 European Pat. Off. ..... 297/301
8814409 3/1989 Fed. Rep. of Germany .

*Primary Examiner*—Peter R. Brown

*Attorney, Agent, or Firm*—Speckman, Pauley & Fejer

[57] ABSTRACT

A chair, in particular a work or office chair, the seat of which is variable in inclination and is pivotal in the forward region about a horizontal pivot shaft. A backrest is mandatorily, disproportionately variable in inclination as a function of the change in seat inclination. With increasing inclination of the seat, the backrest approaches the rear end of the seat. The pivot shaft of the seat is limitedly adjustable both downward and toward the backrest on the bearing block of the chair pedestal. The seat is pivotally connected to pivot levers, one end of each of which is fixedly attached and nonrotatably with respect to the backrest and the other end of each of which is rotatably supported on the bearing block. Synchronous motion with relative motion between the seat and backrest is achieved with an adjustment mechanism disposed only beneath the seat. This mechanism is characterized in that the pivot levers are pivotally attached to the seat, spaced apart by approximately one-fourth the depth from the rear end of the seat. The ends of the pivot levers oriented toward the back rest have two segments located at approximately a right angle to one another. The backrest is firmly connected to the segments forming the free end of the pivot levers or is connected to them in a vertically incrementally or infinitely adjustable manner. The opposite ends of the pivot levers are pivotally attached to the bearing block approximately beneath the middle of the seat and are at an obtuse angle of approximately 150° to 170°, facing toward the floor, from the adjoining segment of the pivot levers.

7 Claims, 5 Drawing Sheets

CHAIR, IN PARTICULAR WORK OR OFFICE CHAIR

CROSS REFERENCE TO RELATED APPLICATIONS

This is a continuation-in-part patent application of my earlier patent application Ser. No. 07/526,463, filed May 21, 1990, now abandoned.

BACKGROUND OF THE INVENTION

1. Field of the Invention

This invention relates to a chair, in particular a work or office chair having a seat with variable inclination, which is pivotal in the forward region about a horizontal pivot shaft, and a backrest, the inclination of which is mandatorily, disproportionately variable as a function of the change in the seat inclination. With increasing inclination of the seat, the backrest approaches the rear end of the seat. The pivot shaft of the seat is limitedly adjustable both downward and toward the backrest on the bearing block of the chair pedestal. The seat is pivotally connected to pivot levers, one end of each of which is fixedly attached and nonrotatable with respect to the backrest and the other end of each of which is rotatably supported on the bearing block.

2. Description of the Prior Art

A chair of type mentioned above is known from German Utility Model 88 14 409. With this adjustment mechanism, such known chair achieves a relative motion between the backrest and the rear end of the seat without additional coupling levers that pivotally connect the front pivot shaft of the seat to the bearing block, such levers being of the kind required in a seat according to German Utility Model 88 06 835. In this known chair, the pivot levers are preferably embodied as armrests and arm supports, because the pivot levers extend past the seat.

SUMMARY OF THE INVENTION

One object of this invention is to provide a chair of the type described above, in which relative motion between the backrest and the rear end of the seat is achieved in combination with a synchronous adjustment of the seat and the backrest, without the adjusting mechanism in the vicinity of the seat having to extend past the seat.

According to one embodiment of this invention, this object is achieved with pivot levers which are pivotally attached to the seat, at a location spaced apart by approximately one-fourth the depth from the rear end of the seat. The ends of the pivot levers oriented toward the back rest have two segments located at approximately a right angle to one another. The backrest is firmly connected to the segments forming the free end of the pivot levers or is connected to them in a vertically incrementally or infinitely adjustable manner. The opposite ends of the pivot levers are pivotally attached to the bearing block approximately beneath the middle of the seat and are at an obtuse angle of approximately 150° to 170°, facing toward the floor, from the adjoining segment of the pivot levers.

The pivot levers are positioned beneath the seat and protrude beyond the seat only in the vicinity of the rear edge and along with these segments they support the backrest. The design is such that the segments of the pivot levers adjoining the pivot bearings in the direction of the backrest between the seat and the pivot levers have a length that is greater than the spacing between the pivot bearings and the rear edge of the seat, so that the pivot levers will not restrict the change in inclination of the seat.

The seat and backrest are rotatable on the bearing block about the rotary bearing of the pivot levers. In combination with the adjustable pivot bearings of the seat on the bearing block, the seat executes a somewhat contrary motion, which leads to shortening the spacing between the backrest and the rear end of the seat. This eliminates the so-called "undressing effect" when the seat is lowered and the backrest for instance pulls one's shirttails out.

To obtain sufficient change in inclination for the seat, a feature of this invention provides that the bearing block slopes upward at an angle of approximately 20° toward the pivot shaft of the seat.

In a feature of this invention, automatically adjusting the seat and backrest to an outset position is achieved by joining the pivot levers in the vicinity of the portions supporting the backrest, and by a gas spring which is supported pivotally on the bearing block and on a crossbar joining the segments together.

The same adjustment of the starting position can also be achieved by a torsion bar spring which is accommodated in the rotary bearings between the pivot levers and the bearing block, or by pivot bearings which are supported on the bearing block between the seat and the pivot levers, by means of a compression spring.

DESCRIPTION OF THE DRAWINGS

This invention is described in detail below in terms of one preferred embodiment shown in the drawing, wherein.

DESCRIPTION OF PREFERRED EMBODIMENTS

Figure 1:
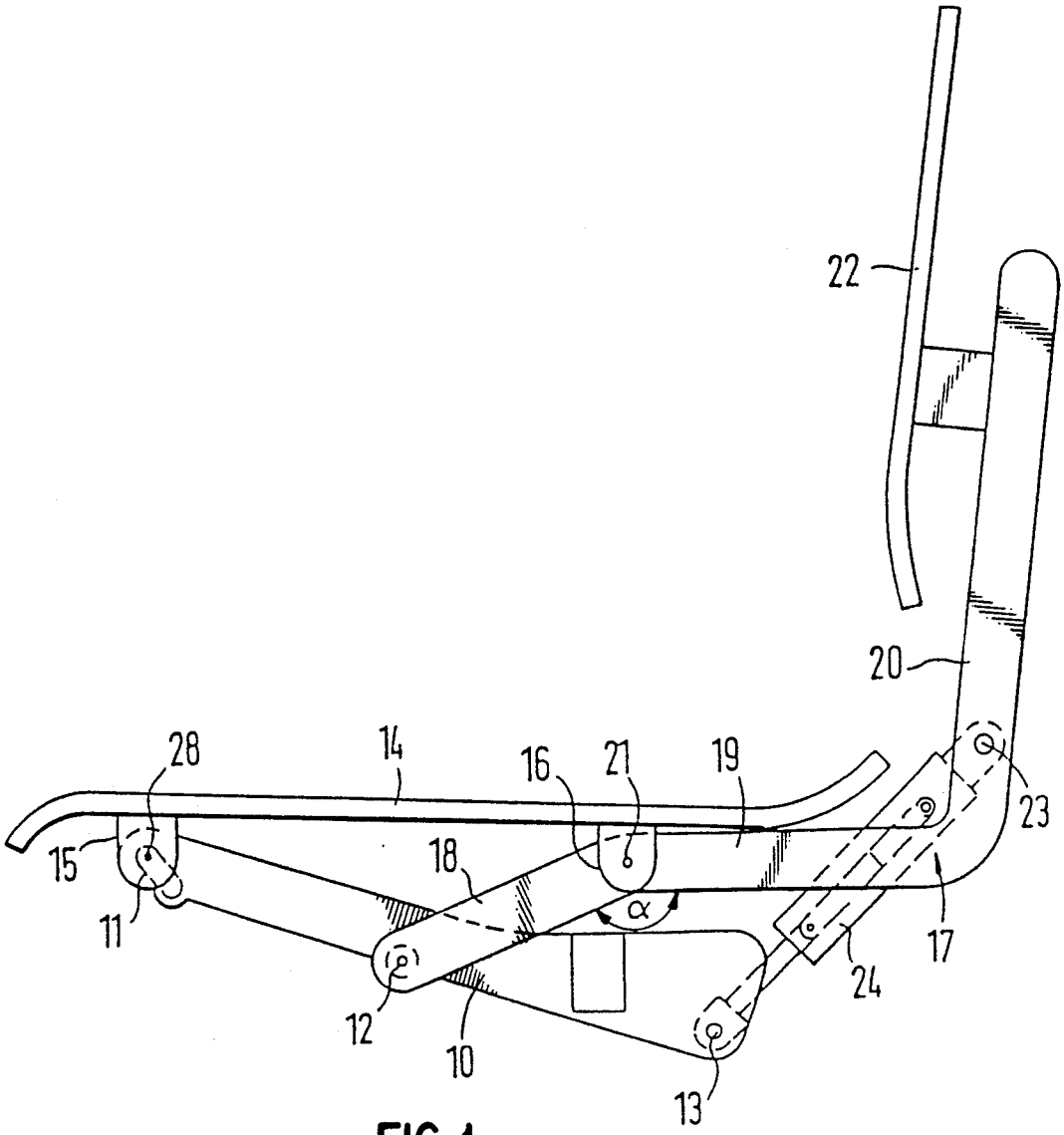
FIG. 1 is a schematic fragmentary side view showing the adjustment mechanism.

In FIG. 1, the adjustment mechanism of the chair according to the invention is schematically shown in a side view. All that is shown of the chair pedestal is the bearing block 10 attached at the upper end. Toward the front edge of the seat 14, of which only the seat support is shown, the bearing block 10 slopes upward at an angle of approximately 20°. The horizontal pivot shaft 28 of the seat 14 is guided such that it is limitedly adjustable downward and toward the backrest in oblong slots 11 in the bearing block 10. In the outset position of the chair, the pivot shaft 28 is located at the upper front end of the oblong slots 11. The two pivot levers 17 are rotatably supported on the underside of the seat 14, located approximately one-third the depth of the seat 14 away from the rear edge of the seat 14.

Figure 2:
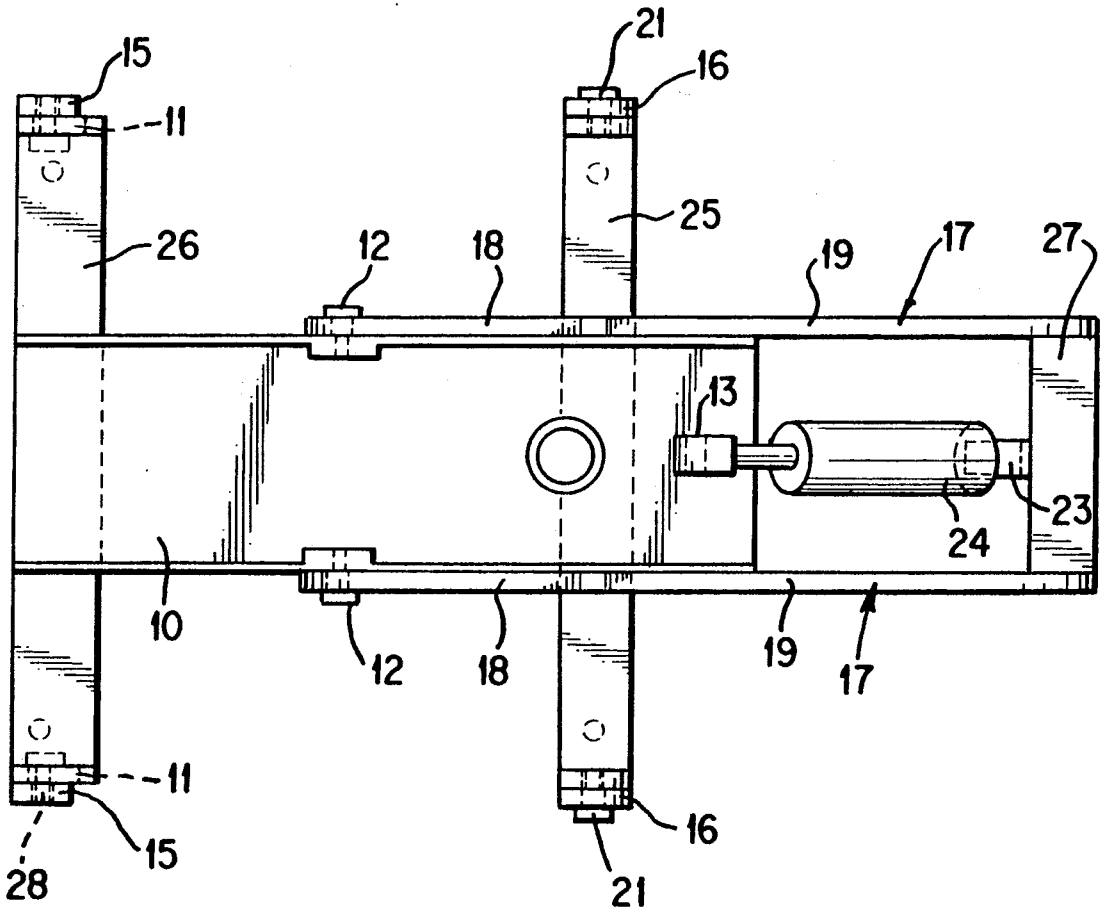
FIG. 2 is a bottom view of the adjustment mechanism.
Figure 2A:
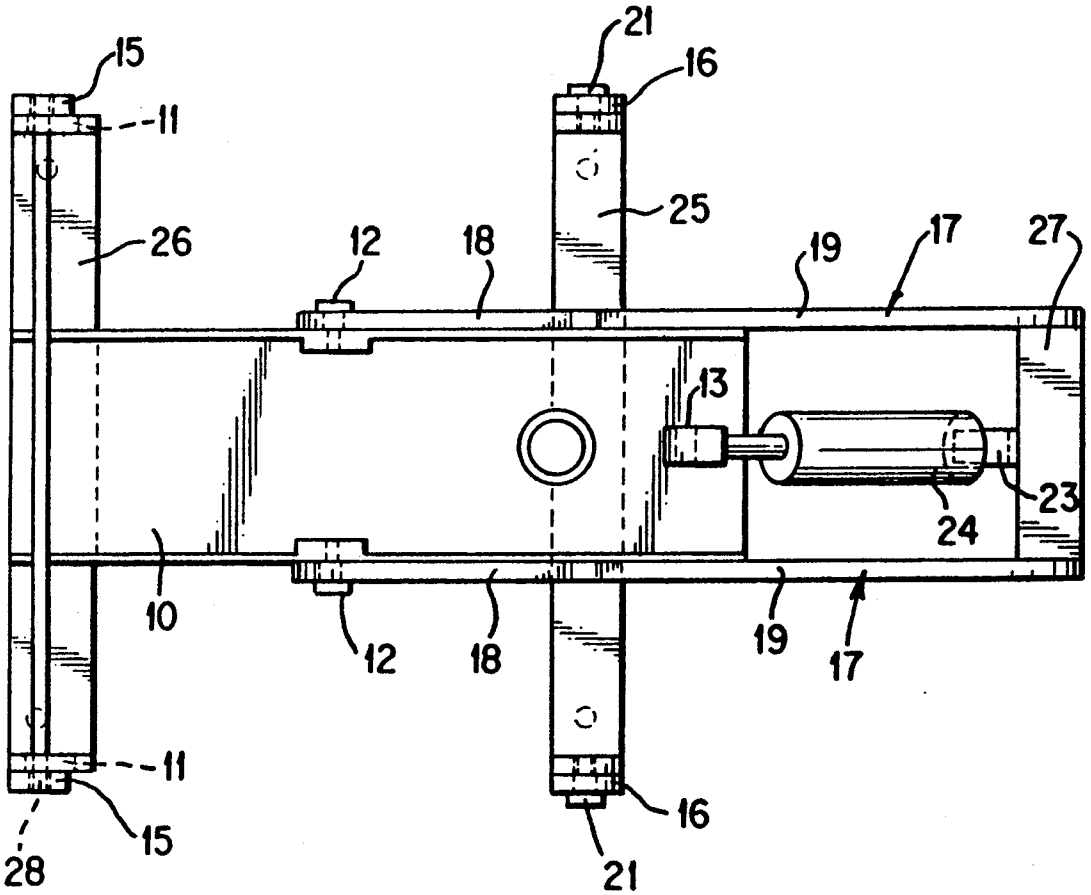
FIG. 2*a* is a bottom view of the adjustment mechanism in accordance with another embodiment of this invention.
Figure 2B:
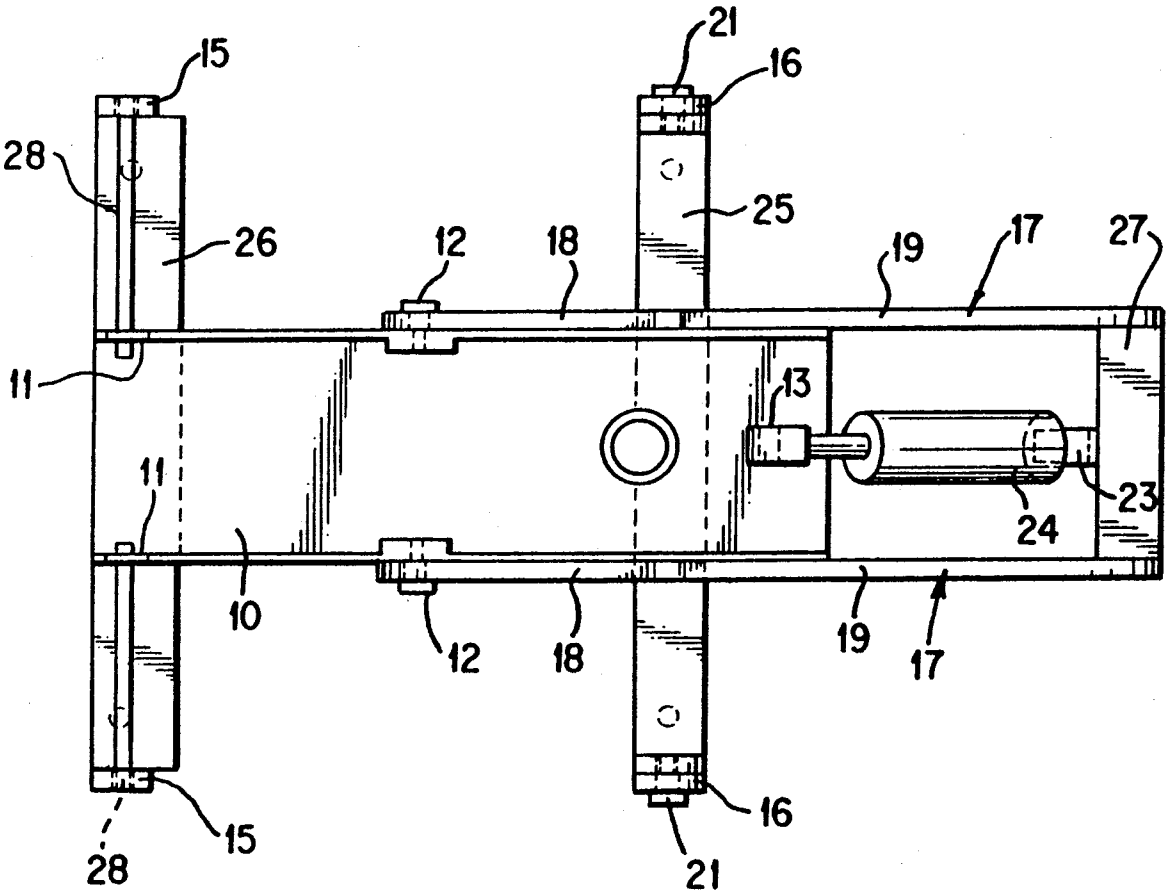
FIG. 2*b* is a bottom view of the adjustment mechanism in accordance with yet another embodiment of this invention.

As FIG. 2 shows, the two pivot levers 17 are firmly joined to one another in the vicinity of the pivot bearing 21 by means of the crossbar 25. The ends of the crossbar 25 are bent downward at right angles and are pivotally attached to the bearing tabs 16 of the seat 14, as the screws indicate, which are passed through a bore of the bearing tabs 16 and threaded within the bent ends of the crossbar 25. From the pivot bearing 21, the pivot levers 17 extend with the segments 18 toward the front side of the seat 14 and are rotatably connected to the bearing block 10 approximately beneath the middle of the seat 14, as the rotary bearings 12 indicate. From the bearing 21, the pivot levers 17 extend toward the rear of the seat 14 and extend approximately horizontally with the segments 19, in the outset position of the chair. The segments 19 extend beyond the rear edge of the seat 14 and merge with the segments 20 that are bent upward at approximately a right angle. The backrest 22 is firmly attached to the segments 20. Of the backrest, only the backrest support is shown. The segments 18 and 19 of the pivot levers 17 form an angle $\alpha$ of approximately 150° to approximately 170° toward the floor on which the chair stands.

As FIG. 2 shows, the segments 20 of the pivot levers 17 are firmly joined to one another via the crossbar 27. The gas spring 24 is pivotally supported on the rear end of the bearing block 10 and on the crossbar 27, as the respective joints 13 and 23 indicate. The gas spring 24 presses the pivot levers 17 upward counterclockwise about the pivot bearings 21, until the segments 19 rest on the underside of the seat 14 and the chair assumes its outset position. The crossbar 26 is attached to the front end of the bearing block 10 and is bent downward at a right angle at its ends. The oblong slots 11 are provided in the bent ends. The tabs 15 of the seat 14 overlap the ends of the crossbar 26 on their outsides. Screws form the pivot shaft and the screws are introduced into the oblong slots 11 from the insides of the ends of the crossbar 26 and mated within threaded bores of the tabs 15.

Figure 3:
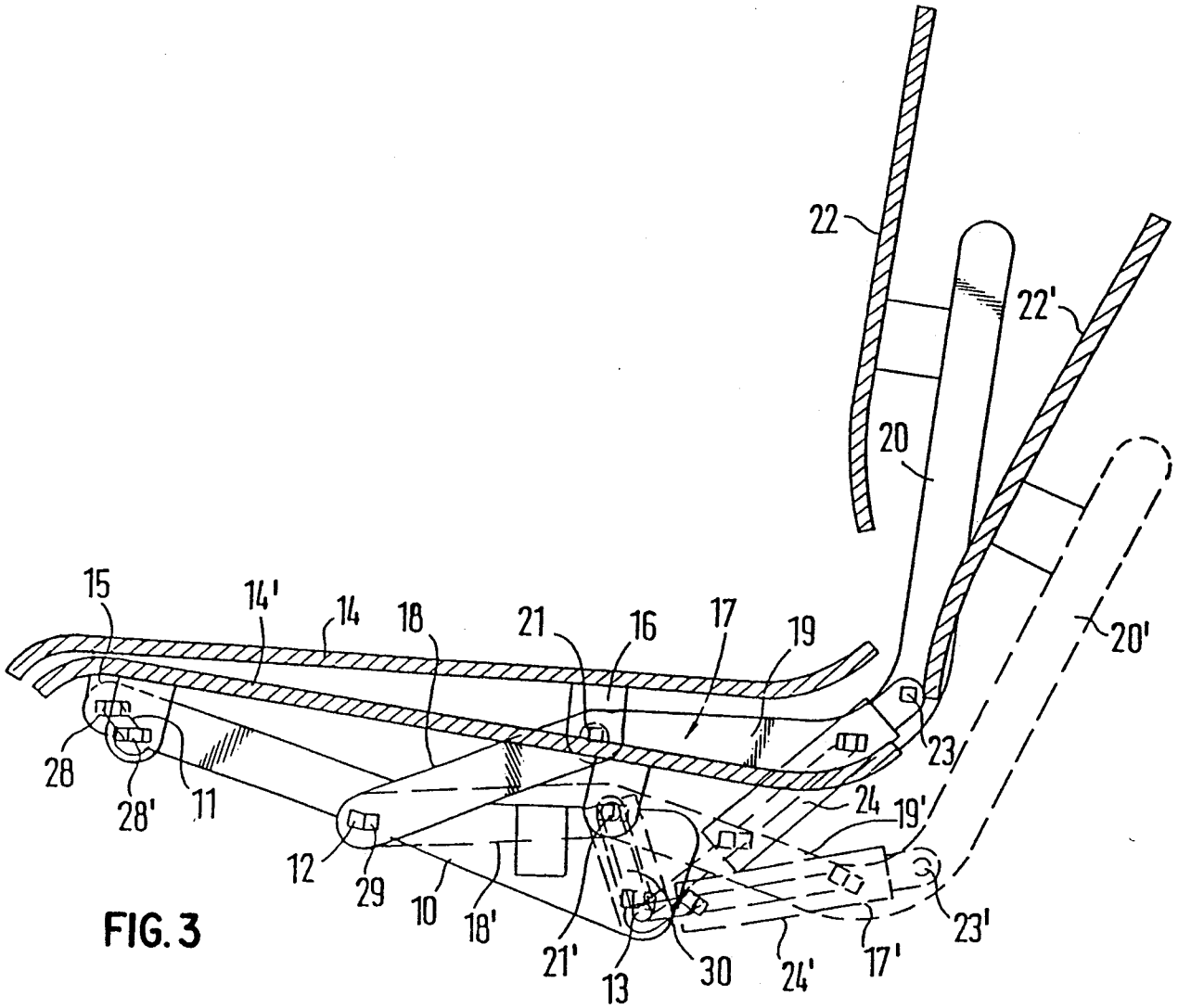
FIG. 3 is a schematic view of the adjustment region of the seat and backrest, with alternative positions for adjusting the chair to the outset position.

In FIG. 3, in addition to the outset position of the chair having the seat 14 and the backrest 22, the lowered position of the seat 14' and the backrest 22' inclined backward are also shown. The drawing clearly shows that the spacing between the facing ends of the seat 14 and the backrest 22 changes upon adjustment to the lower position, as indicated by the seat 14' and the backrest 22'. This spacing can thus be reduced from 62 mm to approximately 30 mm, for example. The horizontal inclination of the seat 14, which is approximately 2°, can increase to approximately 6°, in the course of which the seat 14 inclines continuously downward with respect to the backrest 22 or 22'. If the backrest 22 has an inclination of approximately 7° in the outset position, then the inclination will increase to approximately 18° in the lowered position; that is, the inclination of the backrest 22 increases out of proportion to the inclination of the seat 14. When the seat 14 is lowered, the horizontal pivot shaft 28 of the seat 14 shifts in the oblong slots 11 toward the lower rear ends of the oblong slots 11 into the position 28'. As a result, a somewhat contrary motion of the seat 14 about the pivot bearings 21 is executed, which in the final analysis is responsible for the relative motion between the seat 14 and backrest 22. The pivot bearings 21 shift their position to 21', and the pivot levers 17 are pivoted about the rotary bearings 12 until they assume their position 17' shown by the dashed lines. In this process the gas spring 24 is compressed, because the joint 13 maintains its same position and the joint 23 is lowered into the position 23'. In the lowered position, the segments of the pivot levers 17 assume the positions 18', 19' and 20'.

The gas spring 24 exerts a restoring force upon the pivot levers 17, which returns the seat 14 and backrest 22 to the outset position. The restoring force can also be brought to bear by means of torsion bar springs 29, which are introduced into the rotary bearings 12. The pivot shaft 29 can also receive torsion bar springs of this type. In another embodiment of the invention as shown in FIG. 3, the pivot bearings 21 can also be supported on the bearing block 10 by means of a compression spring 30 that exerts the restoring force upon the pivot levers 17 and seat 14. Compression spring 30 is shown only in the lowered position of the chair.

What is claimed is:

1. In a chair having a seat that is variable in inclination and is pivotal in a forward region about a horizontal pivot shaft, a backrest, an inclination of which is mandatorily disproportionately variable as a function of a change in inclination of the seat, with increasing inclination of the seat the backrest approaching a rear end of the seat, the horizontal pivot shaft of the seat being limitedly adjustable both downward and toward the backrest on a bearing block of a chair pedestal, the seat being pivotally connected to a plurality of pivot levers, each of said pivot levers comprising three segments, a first segment attached to said backrest, a second segment extending at a right angle to said first segment, an end of said second segment opposite said first segment being pivotally attached to the underside of said seat and spaced apart by about ¼ of a depth from said rear end of said seat and a third segment adjoining and extending from the pivotally attached opposite end of said second segment, the improvement comprising:

the end of said third segment (18) opposite said second segment (19) pivotally attached to said bearing block (10) approximately beneath a middle of said seat (14);

said second segment (19) and said third segment (18) forming an obtuse angle of approximately 150° to 170° in a direction facing away from said seat (14), said second segment (19) extending approximately horizontally in an upright position of said chair;

said pivot levers (17) joined together in a vicinity of said first segments (20) which carry said backrest (22), and a gas spring (24) pivotally (13, 23) supported on said bearing block (10) and on a cross bar (27) joining said first segments (20);

a horizontal bearing block crossbar (26) secured to a front end of said bearing block (10), vertical tabs (15) secured to said seat (14) and having bores for receiving shaft ends of said horizontal pivot shaft (28), said vertical tabs overlapping crossbar ends of said horizontal bearing block crossbar (26), said horizontal pivot shaft (28) adjustable limitedly downward and toward said backrest in at least one oblong slot (11) disposed in at least one of said bearing block (10) and each of said crossbar ends of said horizontal bearing block crossbar (26);

and said bearing block (10) inclining upward to an angle of approximately 20° toward said pivot shaft (28) of said seat (14).

2. In a chair according to claim 1, wherein a plurality of pivot bearings (21) are supported on said bearing block (10) between said seat (14) and said pivot levers (17) with a compression spring (30).

3. In a chair according to claim 2, wherein said second segments (19) of said pivot levers (17) adjoining said pivot bearings (21), in a direction of said backrest (22) between said seat (14) and said pivot levers (17), have a length greater than a distance between said pivot bearings (21) and a rear edge of said seat (14).

4. In a chair according to claim 1, wherein pivot bearings (21) are supported on said bearing block (10) between said seat (14) and said pivot levers (17) with a compression spring (30).

5. In a chair according to claim 1, wherein said second segments (19) of said pivot levers (17) each adjoining a pivot bearing (21), in a direction of said backrest (22) between said seat (14) and said pivot levers (17), have a length greater than a a distance between said pivot bearings (21) and a rear edge of said seat (14).

6. In a chair according to claim 1, wherein a torsion bar spring (29) is accommodated in rotary bearings (12) between said pivot levers (17) and said bearing block (10).

7. In a chair according to claim 1, wherein said backrest (22) is firmly connected to said first segment (20) of said pivot levers (17).

* * * * *